US007621787B2

(12) United States Patent
Lu

(10) Patent No.: US 7,621,787 B2
(45) Date of Patent: Nov. 24, 2009

(54) BOLT CONNECTING STRUCTURE OF WIRE

(75) Inventor: Shan-Jui Lu, Xizhi (TW)

(73) Assignee: Lantek Electronics Inc., Taipei County (TW)

( * ) Notice: Subject to any disclaimer, the term of this patent is extended or adjusted under 35 U.S.C. 154(b) by 0 days.

(21) Appl. No.: 12/173,589

(22) Filed: Jul. 15, 2008

(65) Prior Publication Data

US 2009/0269992 A1 Oct. 29, 2009

(30) Foreign Application Priority Data

Apr. 25, 2008 (TW) ..... 97207121 U

(51) Int. Cl.
*H01R 4/36* (2006.01)

(52) U.S. Cl. ..... 439/811; 439/97; 439/812

(58) Field of Classification Search ..... 439/97, 439/810, 811, 812
See application file for complete search history.

(56) References Cited

U.S. PATENT DOCUMENTS 6,339,190 B1 * 1/2002 Chung ..... 174/50
7,029,293 B2 * 4/2006 Shapson et al. ..... 439/97
7,090,514 B2 * 8/2006 Lu ..... 439/97

* cited by examiner

*Primary Examiner*—Tho D Ta
(74) *Attorney, Agent, or Firm*—Guice Patents PLLC

(57) ABSTRACT

The present invention relates to a bolt connecting structure of wire, includes: a housing, which is an electronic device; a connecting seat integratedly provided at a lateral side of the housing, a bolt hole is axially provided on the top surface of the connecting seat, the bottom surface of the connecting seat is provided with at least one contact surface; a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, at least one wire passing slot is provided on the front and the rear walls of the pressing member and is upwardly extended from the bottom sheet; and a bolt having a head section for being operated by tools and a thread section, the thread section is screwed and passed through the adjusting screw hole and the bottom end of the thread section is extended into the bolt hole; by rotating the bolt, the pressing member is driven to longitudinally move, the distance between the bottom sheet and the contact surface is changed so a wire is more easily to be inserted into the frame slot via the wire passing slot, and the wire is pressed and clamped by the bottom sheet and the contact surface.

16 Claims, 8 Drawing Sheets

BOLT CONNECTING STRUCTURE OF WIRE

BACKGROUND OF THE INVENTION

1. Field of the Invention

The present invention relates to a bolt connecting structure of wire, more particularly to a bolt connecting structure of wire that applies a unified force on wires, e.g. grounding wires and the established connection is firm.

2. Description of Related Art

An electronic device, such as a coaxial cable distributor, a signal amplifier, or a directional coupler module having functions of distributing, coupling and amplifying, has a certain level of voltage, for preventing signals from being interfered and preventing operators from being injured, a grounding device is often adopted in an electronic device for avoiding the possible damages to signals or human beings. Now days, a grounding seat is often provided on an electronic device for pressing a grounding wire via a means of radially moving a bolt.

The above mentioned art has been disclosed in many patents, such as Taiwan Patent No. 428813. A connecting device for a grounding wire is desired to be stable and firm in a pressing operation and simple and easy in assembly, and to prevent units from unintentionally being removed during releasing.

Taiwan Patent No. M259379, titled "Radial connection structure of screw in electrical wire" has disclosed that a connecting seat is provided on a housing, and a pressing member is provided inside the connecting seat and a bolt is provided and served to be screwed for fastening a grounding wire, so disadvantages of a conventional grounding structure is significantly improved, and the unintentional loosing of the pressing member during the bolt is operated with a radial movement can be avoided; the pressing member passes through an accommodating section provided on the connecting seat at a top stopping point for being connected with a bolt; when in a releasing status, in other words the pressing member is moved to the top stopping point, there is a possibility that the pressing member may radially disengages. Therefore how to let a pressing member constantly connect with a bolt when the bolt is in a pressing or a releasing status is needed to be improved.

SUMMARY OF THE INVENTION

The applicant has devoted himself to design and commercially distribute electronic devices, especially directional coupler modules, coaxial cable distributors and signal amplifiers, with a hope to overcome the problems that connection between a pressing member and a bolt is not adequate enough and the pressing member may laterally disengage when the connection of pressing member and the bolt is in a releasing status, after try and error, the present invention "Bolt connecting structure of wire" is provided.

One object of the present invention is to provide a bolt connecting structure of wire in which a pressing member is provided on a connecting seat, and the pressing member is longitudinally moved when a bolt is rotated, so the distance between a bottom sheet of the pressing member and a contact surface of the connecting seat is changed thus wires are more easily to be inserted, pressed or clamped, the connection of the wires and the connecting seat is firmer and more reliable and the applied force is unified.

Another object of the present invention is to provide a bolt connecting structure of wire that is simple in structure and less components are needed, so production cost is lowered, assembling processes and the operating time are reduced, especially for an operation of connecting a ground wire.

For achieving the above mentioned objects, one means provided by the present invention is to provide a bolt connecting structure of wire, includes: a housing, which is an electronic device; a connecting seat integratedly provided at a lateral side of the housing, a bolt hole is axially provided on the top surface of the connecting seat, the bottom surface of the connecting seat is provided with at least one contact surface; a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, at least one wire passing slot is provided on the front and the rear walls of the pressing member and is upwardly extended from the bottom sheet; and a bolt having a head section for being operated by tools and a thread section, the thread section is screwed and passed through the adjusting screw hole and the bottom end of the thread section is extended into the bolt hole; by rotating the bolt, the pressing member is driven to longitudinally move, the distance between the bottom sheet and the contact surface is changed so a wire is more easily to be inserted into the frame slot via the wire passing slot, and the wire is pressed and clamped by the bottom sheet and the contact surface.

Another means provided by the present invention is to provide a bolt connecting structure of wire, includes: a housing, which is an electronic device; a connecting seat integratedly provided at a lateral side of the housing, a bolt hole is axially provided on the top surface of the connecting seat, the bottom surface of the connecting seat is provided with at least one contact surface, at least one wall located below the bolt hole is radially provided with an anti-disengaging screw hole; a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, a position limiting slot and a wire passing slot are respectively provided on the two opposite walls of the pressing member with respect to the anti-disengaging screw hole, an anti-disengaging screw is provided and is screwed into the anti-disengaging screw hole, and the head section of the anti-disengaging screw is received in the position limiting slot; and a bolt having a head section for being operated by tools and a thread section, the thread section is screwed and passed through the adjusting screw hole and the bottom end of the thread section is extended into the bolt hole; by rotating the bolt, the pressing member is driven to longitudinally move, the distance between the bottom sheet and the contact surface is changed so a wire is more easily to be inserted into the frame slot via the position limiting slot or the wire passing slot, and the wire is pressed and clamped by the bottom sheet and the contact surface.

One another means provided by the present invention is to provided a bolt connecting structure of wire, includes: a housing, which is an electronic device; a connecting seat integratedly provided at a lateral side of the housing, a bolt hole is axially provided on the top surface of the connecting seat, the bottom surface of the connecting seat is provided with at least two contact surfaces, at least one wall located below the bolt hole is radially provided with an anti-disengaging screw hole;

a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, a position limiting slot and a wire passing slot are respectively provided on the two opposite walls of the pressing member with respect to the anti-disengaging screw hole, the front and the rear walls of one lateral side of the pair of the slots are provided with at least a pair of wire passing slots, an anti-disengaging screw is provided and is screwed into the anti-disengaging screw hole, and the head section of the anti-disengaging screw is received in the position limiting slot; and a bolt having a head section for being operated by tools and a thread section, the thread section is screwed and passed through the adjusting screw hole and the bottom end of the thread section is extended into the bolt hole; by rotating the bolt, the pressing member is driven to longitudinally move, the distance between the bottom sheet and the contact surface is changed so at least two wires are easily to be inserted into the frame slot via at least one of the wire passing slots and the position limiting slot, and the wires are pressed and clamped by the bottom sheet and the contact surfaces.

DETAILED DESCRIPTION OF THE PREFERRED EMBODIMENT

Figure 1:
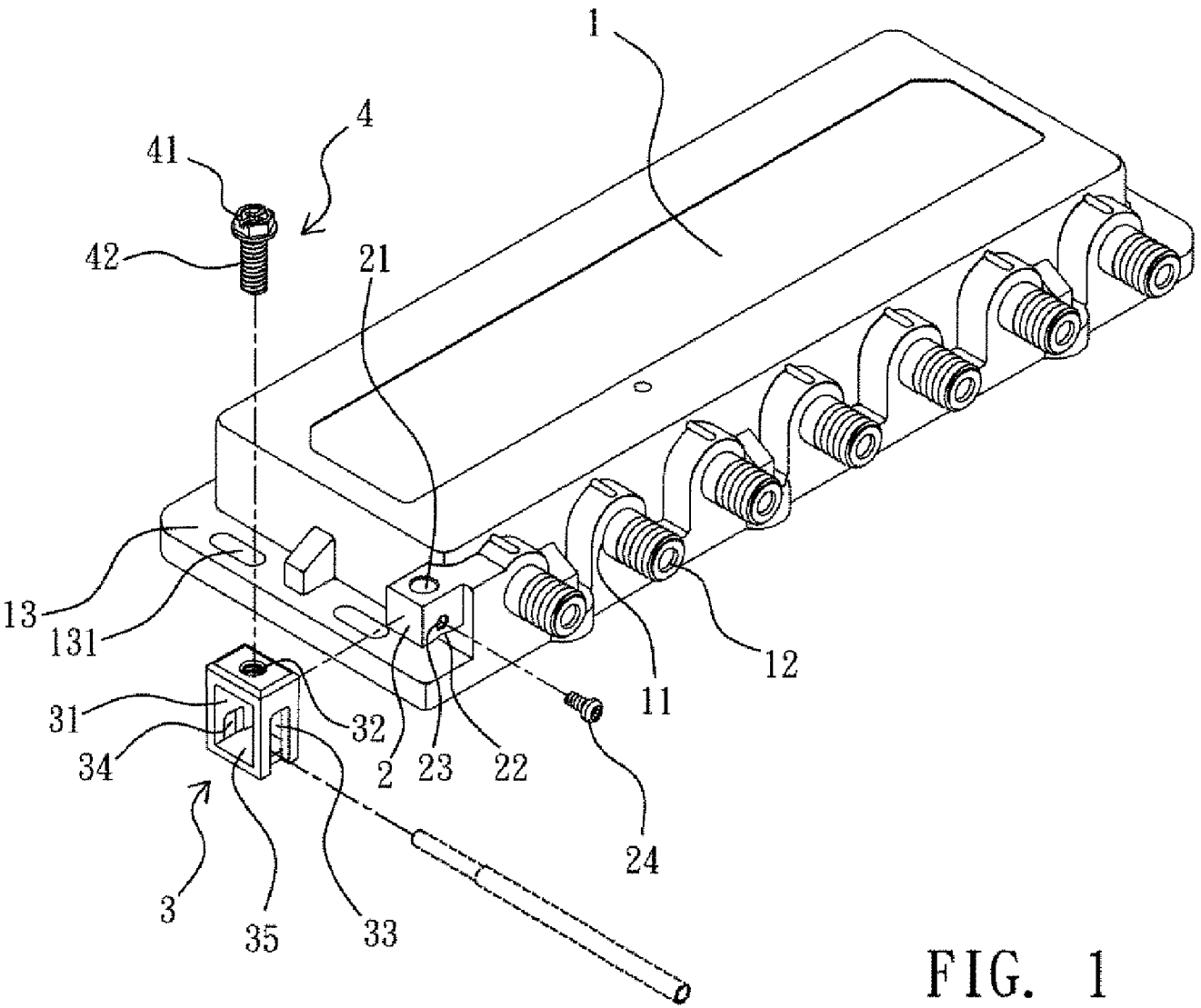
FIG. 1 is a 3D exploded view of the bolt connecting structure of wire provided by the present invention being adopted in a directional coupler module.
Figure 2:
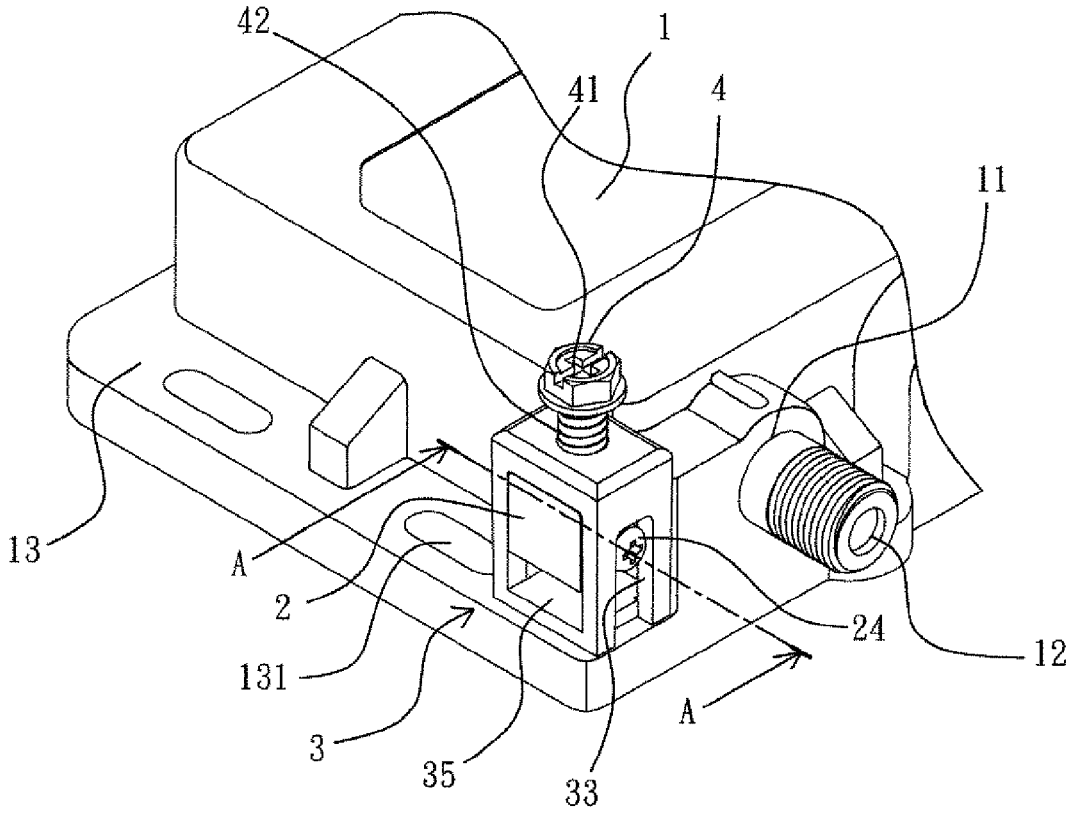
FIG. 2 is a 3D partial enlarged view of the bolt connecting structure of wire after being assembled.
Figure 3:
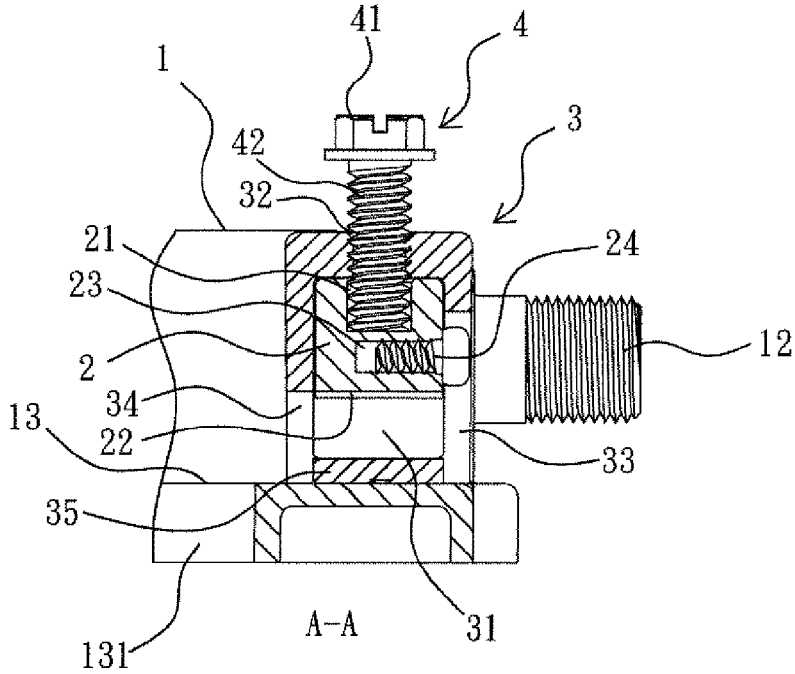
FIG. 3 is a cross section view of FIG. 2 intercepted along an A-A line.

As shown from FIG. 1 to FIG. 3, the bolt connecting structure of wire provided by the present invention is composed by a housing 1, a connecting seat 2, a pressing member 3 and a bolt 4. The housing 1 provided by the present invention can be adopted in an electronic device e.g., but not limited to, a coaxial cable distributor, a signal amplifier or a directional coupler module having functions of distributing, coupling and amplifying.

The housing 1 is an electronic device having relative circuits or electronic units, and a directional coupler module is herein adopted for illustrating the embodiment, the housing 1 is provided with at least a through hole 11 for being provided with a coaxial cable joint 12. At least one lateral side of the housing 1 is extendedly provided with a wing section 13 having at least a lock hole 131 so the housing 1 can be fastened on an object, such as a utility pole or a wall, via a connecting unit, such as a screw. The shape of the lock hole 131 is preferably in a long-stripe shape for more easily being positioned with respect to a preset hole of the object.

The connecting seat 2 is provided at one lateral side of the housing 1, the connecting seat 2 is a grounding seat preferably formed with the housing 1 as one piece, the connecting seat 2 is served to connect and retain grounding wires, so a bolt hole 21 is axially provided at the top surface of the connecting seat 2, the diameter of the bolt hole 21 is larger than that of the bolt 4 so the bolt 4 can be provided in the bolt hole 21; the bottom end of the connecting seat 2 is provided with at least one reverse-V-shaped or arc-shaped contact surface 22 for pressing wires, especially for pressing the exposed metal ends of the grounding wires; a gap is formed between the connecting seat 2 and the wing section 13 provided below the connecting seat 2 so the pressing member 3 can be provided on the connecting seat 2. For preventing the pressing member 3 from laterally disengaging, an anti-disengaging screw hole 23 is provided at a front or a rear wall of the connecting seat 2 and is provided below the bolt hole 21 so an anti-disengaging screw 24 can be screwed in.

The pressing member 3 is a frame-shaped member, a through frame slot 31 is transversally provided in the pressing member 3, the inner length and the inner width of the frame slot 31 are the same as those of the connecting seat 2, but the height of the frame slot 31 is larger than that of the connecting seat 2 so the frame slot 31 can be moveably provided on the connecting seat 2. The top surface of the pressing member 3 is provided with an adjusting screw hole 32 with respect to the bolt hole 21 and the front and the rear walls of the pressing member 3 are respectively provided with a position limiting slot 33 and a wire passing slot 34 that are upwardly extended from a bottom sheet 35, so the exposed metal end of the wire can be inserted. The position limiting slot 33 is provided on the same side as the anti-disengaging screw hole 23, when the anti-disengaging screw 24 is screwed in the anti-disengaging screw hole 23, the head section of the anti-disengaging screw 24 is received in the position limiting slot 33 for being served to block and prevent the pressing member 3 from laterally disengaging from the connecting seat 2.

The bolt 4 is a conventional connecting unit, from the top end to the bottom end of the bolt 4 can be respectively defined as a head section 41 for being operated by tools and a thread section 42. When being assembled, the thread section 42 of the bolt 4 is downwardly screwed into the adjusting screw hole 32 of the pressing member 3, so the bottom end of the thread section 42 is extended into the bolt hole 21 and is in contact with the bottom wall of the bolt hole 21.

The 3D view of the embodiment of the present invention after being assembled is as shown in FIG. 2; the cross section view shown in the FIG. 3 is the cross plane of FIG. 2 intercepted along an A-A line. The bolt 4 is screwed on the top surface of the pressing member 3 and is extended into the connecting seat 2; with an interfering effect generated when the bolt 4 passes through the pressing member 3, the pressing member 3 can be efficiently prevented from laterally disengaging from the connecting seat 2. If the bolt 4 is reversely screwed and is away from the top surface of the pressing member 3, the pressing member 3 can still be prevented from laterally disengaging from the connecting seat 2 as the head section of the anti-disengaging screw 24 is received in the position limiting slot 33.

Figure 4:
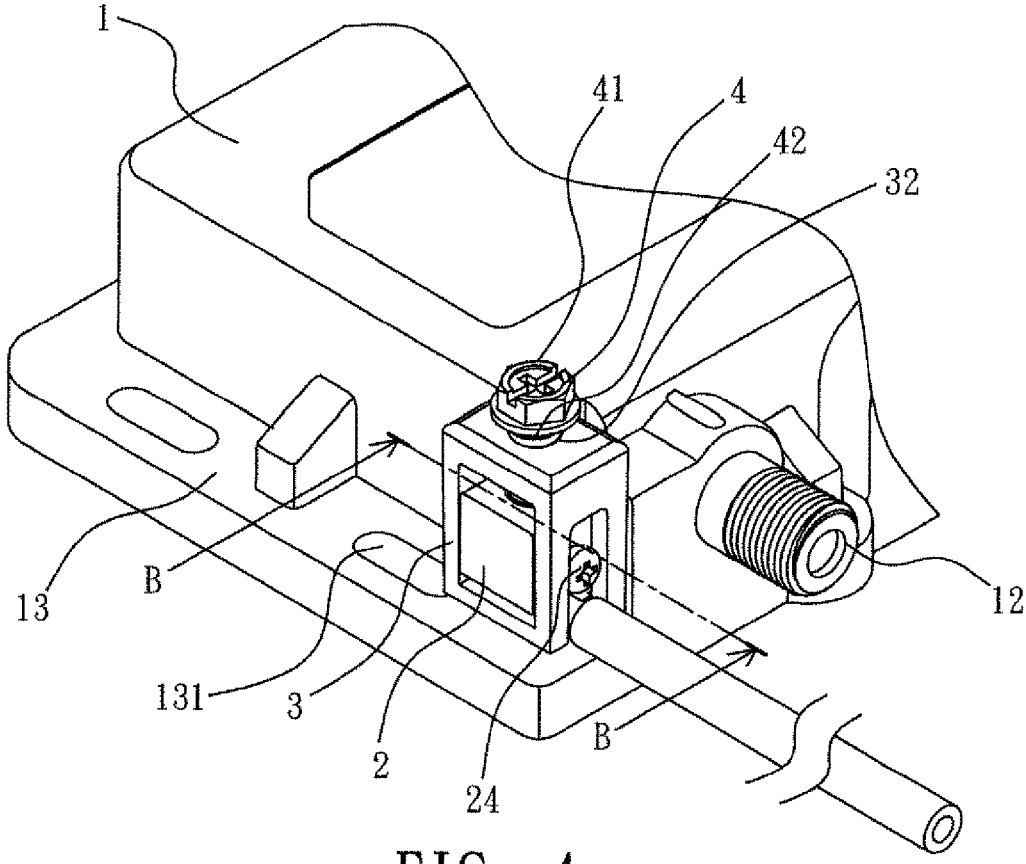
FIG. 4 is a 3D partial enlarged view illustrating wire pressing of the bolt connecting structure of wire provided by the present invention.
Figure 5:
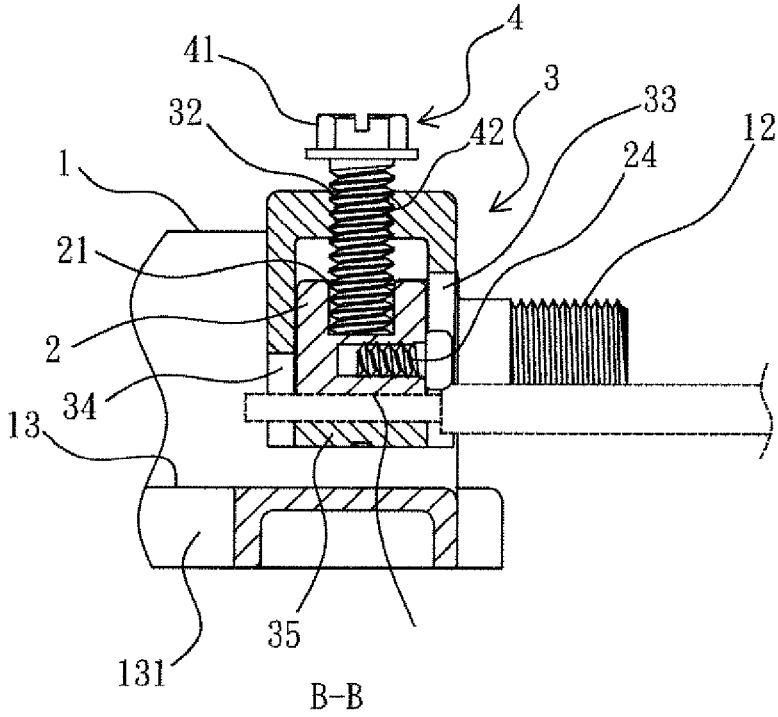
FIG. 5 is a cross section view of FIG. 4 intercepted along a B-B line.

As shown in FIG. 4 and FIG. 5, if an exposed metal end of a wire, especially a grounding wire (shown as a dotted wire in figures) is desired to be retained on the connecting seat 2, firstly the bolt 4 is rotated by a tool so the pressing member 3 is downwardly moved via the adjusting screw hole 32, and the distance between the bottom sheet 35 of the pressing member 3 and the contact surface 22 provided at the bottom end of the connecting seat 2 is enlarged, so the grounding wire is easily to be passed through the position limiting slot 33 and the wire passing slot 34 of the pressing member 3; then the bolt 4 is reversely rotated by the tool so the pressing member 3 is upwardly moved via the adjusting screw hole 32, and the distance between the bottom sheet 35 of the pressing member 3 and the contact surface 22 provided at the bottom end of the connecting seat 2 is gradually shorten until the grounding wire is clamped between the bottom sheet 35 and the contact surface 22, so the grounding wire is more firmly pressed and the force applied on the grounding wire is unified.

Figure 6:
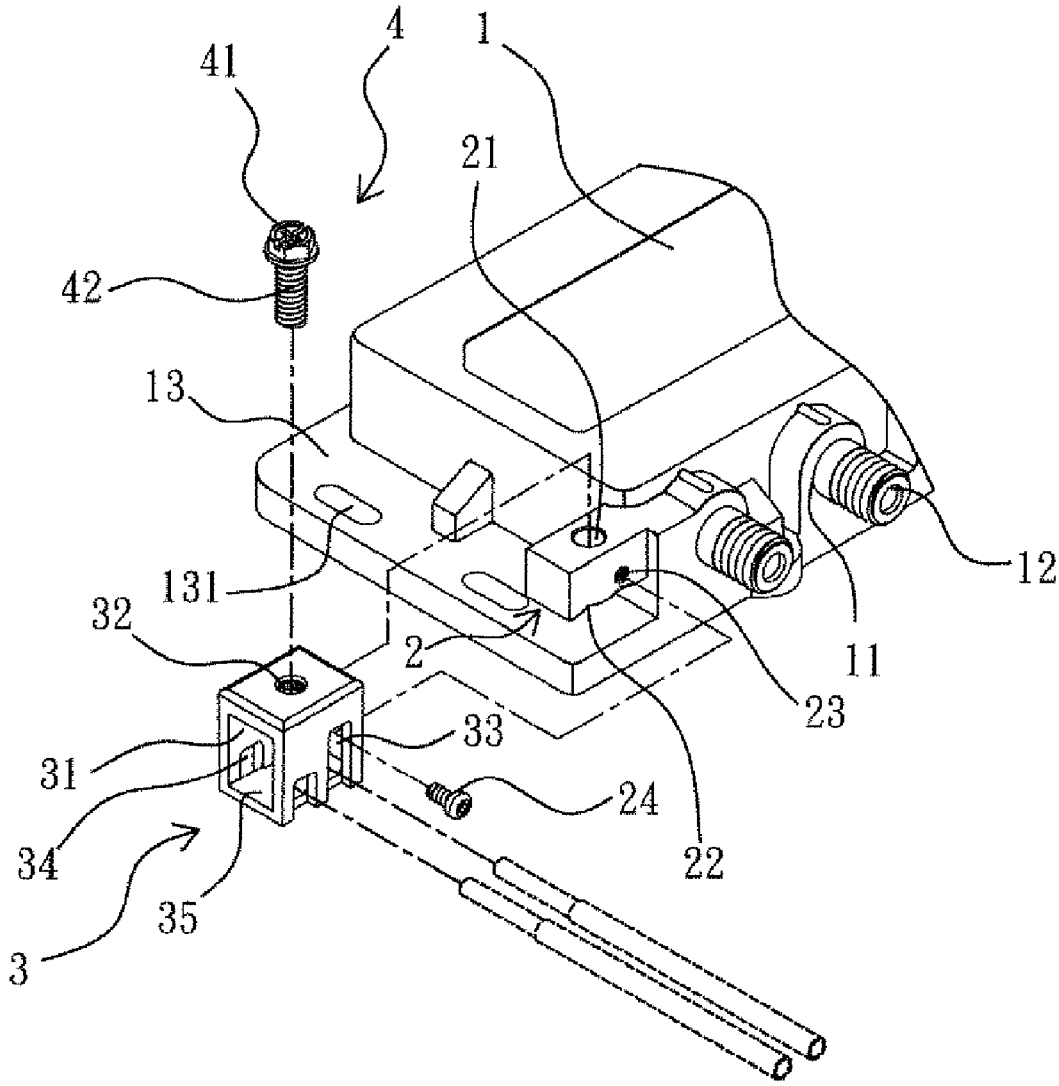
FIG. 6 is a 3D exploded view of the bolt connecting structure of wire of another embodiment of the present invention being adopted in a directional coupler module.
Figure 7:
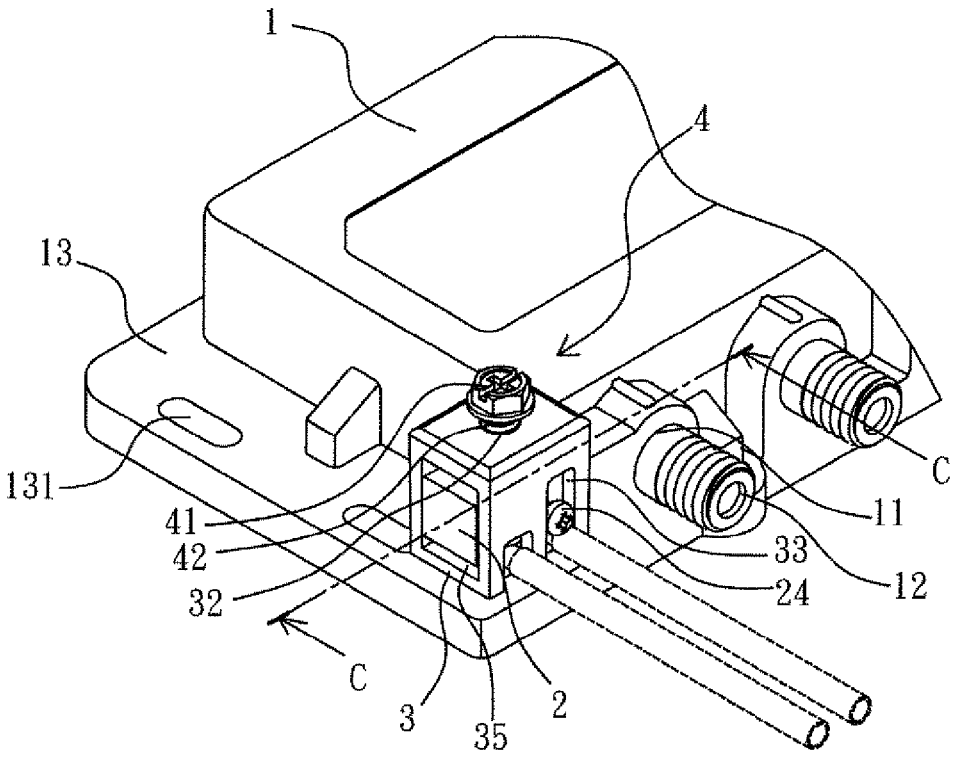
FIG. 7 is a 3D partial enlarged view of FIG. 6 after being assembled.
Figure 8:
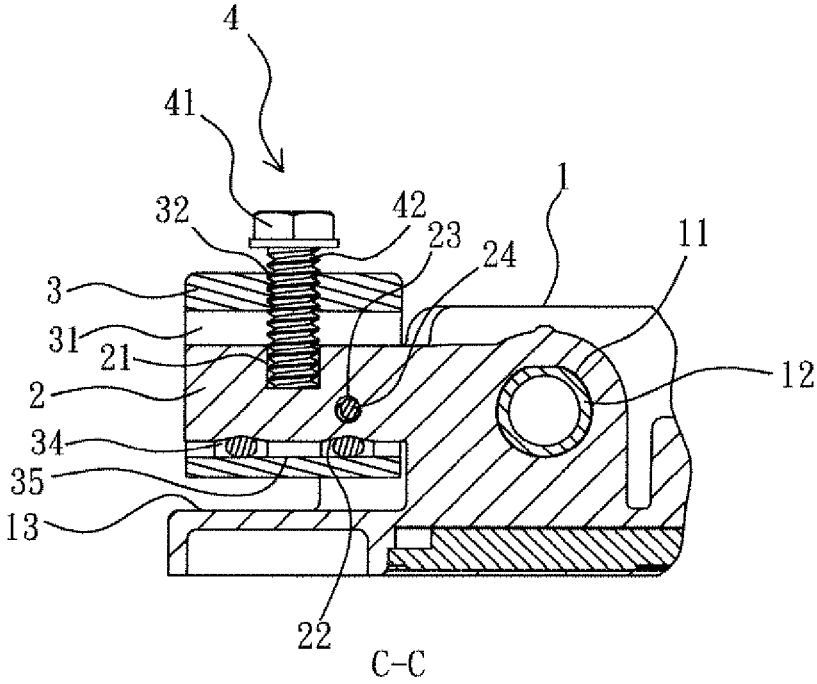
FIG. 8 is a cross section view of FIG. 7 intercepted along a C-C line.

FIG. 6 is a 3D exploded view of the bolt connecting structure of wire of another embodiment of the present invention and in this embodiment at last two wires are connected and pressed, thus the size of the pressing member 3 and the size of the connecting seat 2 are larger than those illustrated in the previous embodiment. The difference between the pressing member 3 of the embodiment and the pressing member 3 of the previous embodiment is that a longer position limiting slot 33 and a shorter wire passing slot 34 are respectively provided at the front and the rear walls of the pressing member 3 and are provided on top of a bottom sheet 35 with respect to the anti-disengaging screw hole 23, and the front and the rear walls of one lateral side of the pair of the slots are provided with at least a pair of wire passing slots 34. When the bolt 4 is rotated, the adjusting screw hole 32 of the pressing member 3 is upwardly moved alongside the thread section 42, so at least two wires are clamped between the bottom sheet 35 and the two V-shaped or arc-shaped contact surfaces 22 provided at the bottom end of the connecting seat 2. After being assembled, the 3D view is as shown in FIG. 7. As shown in FIG. 8, which is a cross section view of the FIG. 7 intercepted along a C-C line, two wires, especially two grounding wires, are simultaneously clamped and pressed by the pressing member 3 and the connecting seat 2.

Figure 9:
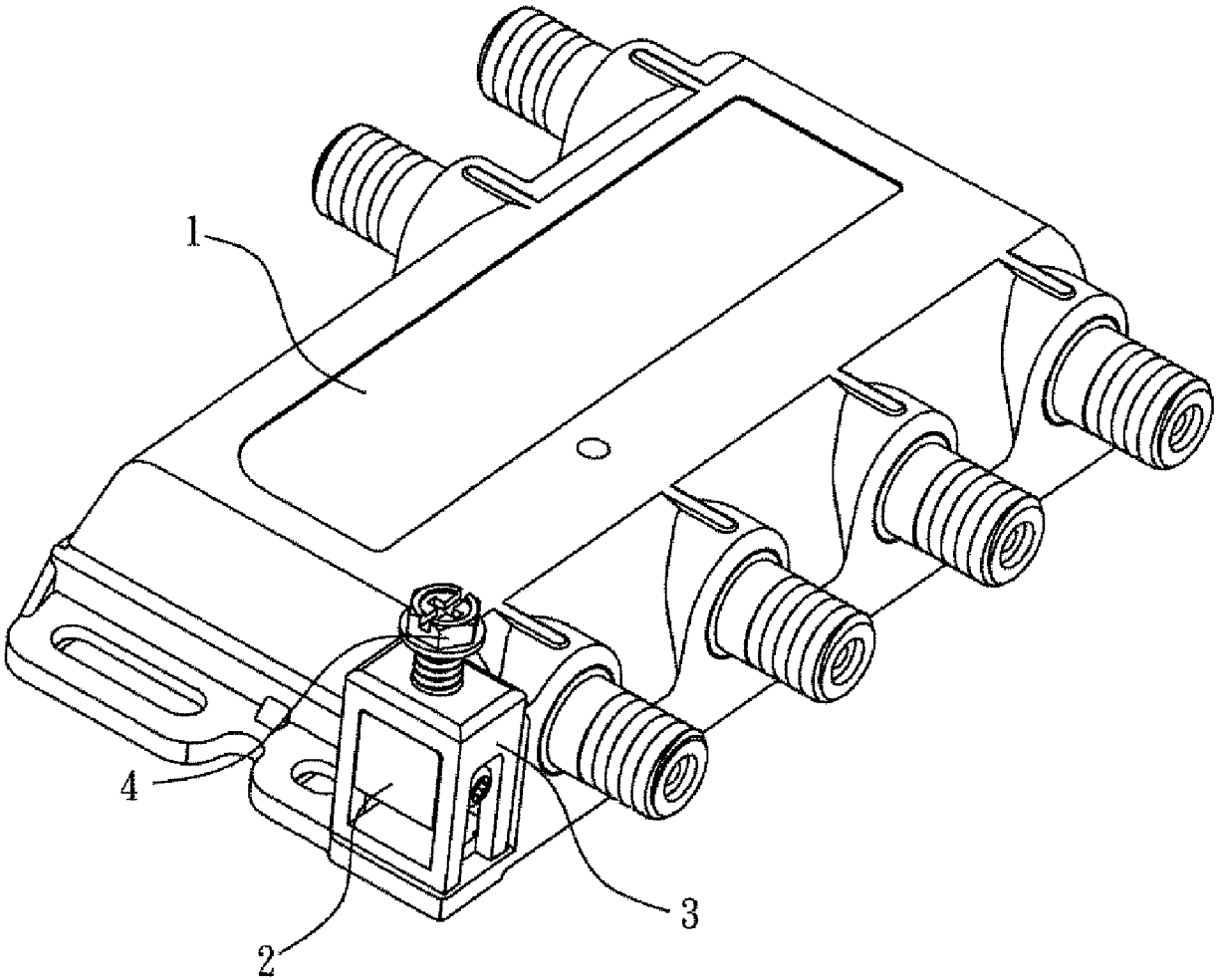
FIG. 9 is a schematic view of the bolt connecting structure of wire provided by the present invention being adopted in a signal amplifier.
Figure 10:
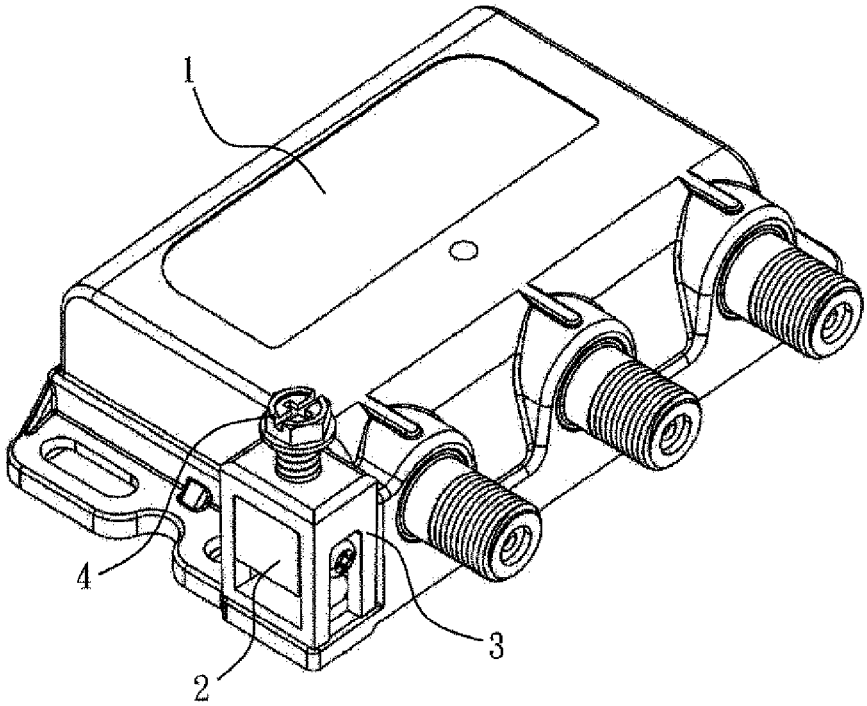
FIG. 10 is a schematic view of the bolt connecting structure of wire provided by the present invention being adopted in a signal amplifier.
Figure 11:
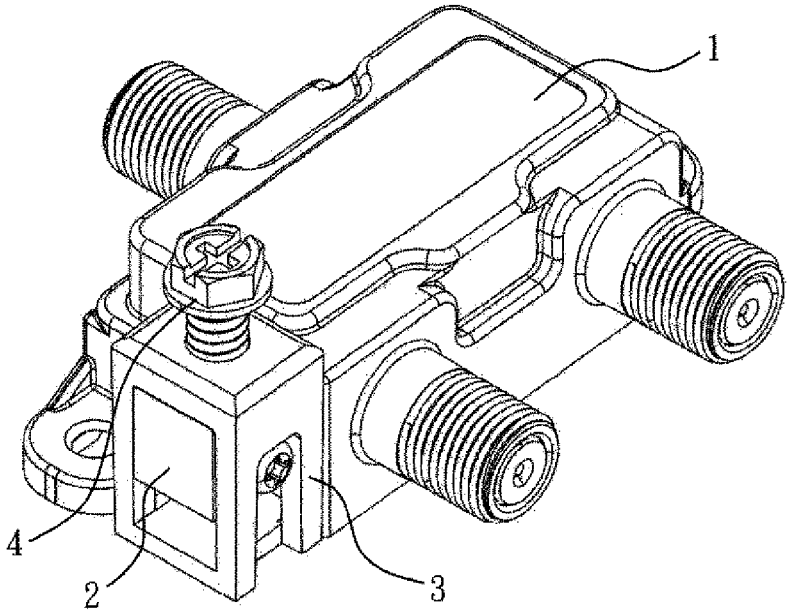
FIG. 11 is a schematic view of the bolt connecting structure of wire provided by the present invention being adopted in a coaxial cable distributor.
Figure 12:
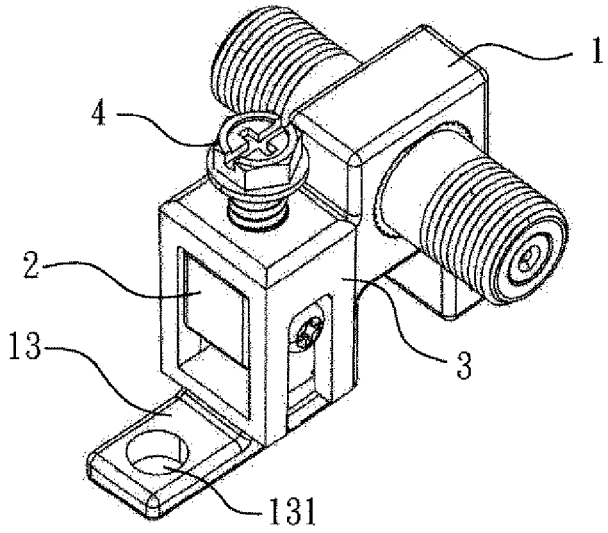
FIG. 12 is a 3D view of the bolt connecting structure of wire provided by the present invention being adopted in a single grounding device.
Figure 13:
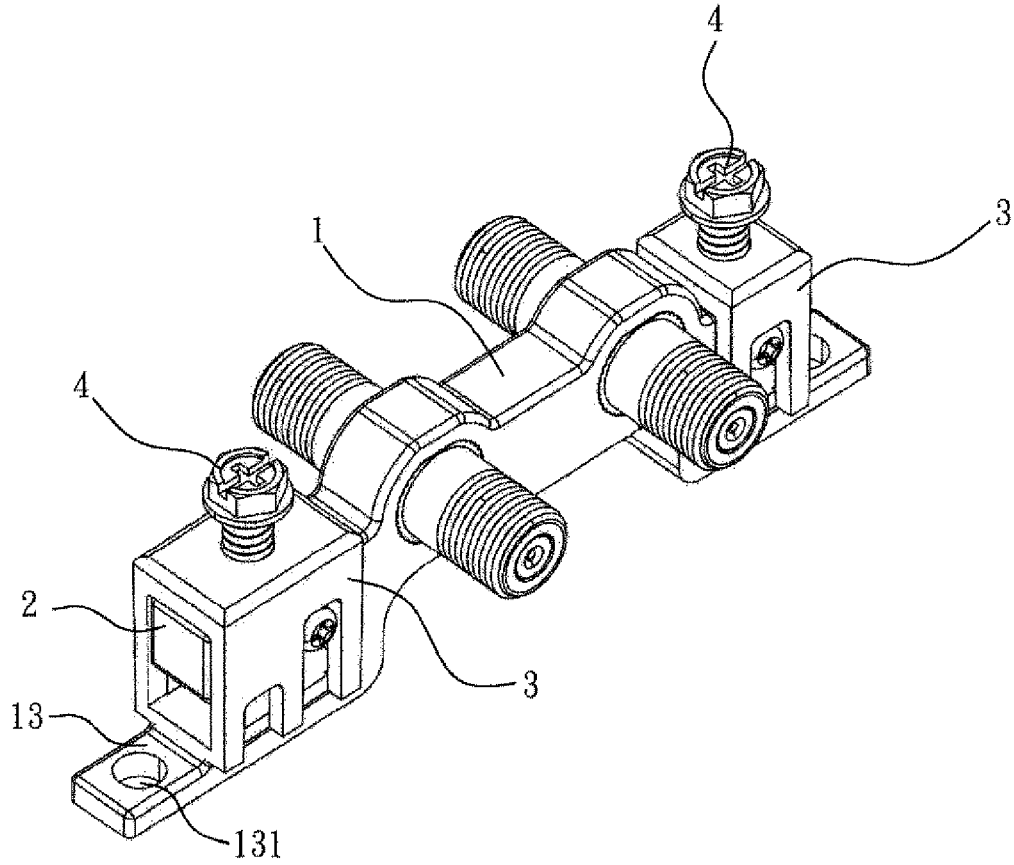
FIG. 13 is a 3D view of the bolt connecting structure of wire provided by the present invention being adopted in a double grounding device.

As shown from FIG. 1 to FIG. 8, the embodiments mentioned above of the bolt connecting structure of wire use a directional coupler module having functions of signal distributing, coupling and amplifying as an example but the application of the present invention is not limited to said directional coupler module, so shown in FIG. 9 and FIG. 10, which are schematic views of the bolt connecting structure of wire respectively being adopted in signal amplifiers whose ratio of input and output are 2:4 and 1:2; as shown in FIG. 11, which is a schematic view of the bolt connecting structure of wire being adopted in a coaxial cable distributor whose ratio of input and output is 1:2; as shown in FIG. 12, which is a schematic view of bolt connecting structure of wire provided by the present invention being adopted in a single grounding device; and as shown in FIG. 13, which is a schematic view of the bolt connecting structure of wire provided by the present invention being adopted in a double grounding device. FIG. 9 to FIG. 13 are schematic views of the bolt connecting structure of wire being adopted in various electronic devices.

The present invention has disclosed that a pressing member is provided on a connecting seat, a bolt is provided and screwed and passed through the pressing member, so the bottom end of the bolt is inserted into the top surface of the connecting seat; by rotating the bolt, the pressing member are longitudinally moved, so the distance between the bottom sheet of the pressing member and a contact surface is changed, a wire is therefore easily to be inserted, pressed or clamped; the combination of the wire and the connecting seat is firmer and the applied force is unified; with an interfering effect generated when the bolt passes through the pressing member, the pressing member can be efficiently prevented from laterally disengaging from the connecting seat; the pressing member can also be prevented from laterally disengaging from the connecting seat as the head section of the anti-disengaging screw is received in the position limiting slot; so the grounding wire is more firmly pressed by the pressing member and the force applied on the grounding wire is unified.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bolt connecting structure of wire, comprises:

a housing, which is an electronic device;

a connecting seat integratedly provided at a lateral side of the housing, a bolt hole is axially provided on the top surface of the connecting seat, the bottom surface of the connecting seat is provided with at least one contact surface;

a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, at least one wire passing slot is provided on the front and the rear walls of the pressing member and is upwardly extended from the bottom sheet; and a bolt having a head section for being operated by tools and a thread section, the thread section is screwed and passed through the adjusting screw hole and the bottom end of the thread section is extended into the bolt hole;

by rotating the bolt, the pressing member is driven to longitudinally move, the distance between the bottom sheet and the contact surface is changed so a wire is more easily to be inserted into the frame slot via the wire passing slot, and the wire is pressed and clamped by the bottom sheet and the contact surface.

2. The bolt connecting structure of wire as claimed in claim 1, wherein a pair of wire passing slots is provided on the front and the rear walls of the pressing member and is upwardly extended from the bottom sheet, so the wire is inserted via one of the wire passing slots and is passed through via the other wire passing slot.

3. The bolt connecting structure of wire as claimed in claim 1, wherein the contact surface is in a reverse-V-shape or an arc-shape.

4. The bolt connecting structure of wire as claimed in claim 1, wherein the electronic device is a coaxial cable distributor, a single grounding device, a double grounding device, a signal amplifier, or a directional coupler module having functions of signal distributing, coupling and amplifying, and the connecting seat is a grounding seat.

5. The bolt connecting structure of wire as claimed in claim 1, wherein a wing section having at least one lock hole is transversally extended from at least one lateral side of the housing, and a gap is formed between the wing section and the connecting seat provided above the wing section.

6. The bolt connecting structure of wire as claimed in claim 5, wherein the shape of the lock hole is in a long-stripe shape.

7. A bolt connecting structure of wire, comprises:

a housing, which is an electronic device;

a connecting seat integratedly provided at a lateral side of the housing, a bolt hole is axially provided on the top surface of the connecting seat, the bottom surface of the connecting seat is provided with at least one contact surface, at least one wall located below the bolt hole is radially provided with an anti-disengaging screw hole;

a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, a position limiting slot and a wire passing slot are respectively provided on the two opposite walls of the pressing member with respect to the anti-disengaging screw hole, an anti-disengaging screw is provided and is screwed into the anti-disengaging screw hole, and the head section of the anti-disengaging screw is received in the position limiting slot; and a bolt having a head section for being operated by tools and a thread section, the thread section is screwed and passed through the adjusting screw hole and the bottom end of the thread section is extended into the bolt hole;

by rotating the bolt, the pressing member is driven to longitudinally move, the distance between the bottom sheet and the contact surface is changed so a wire is more easily to be inserted into the frame slot via the position limiting slot or the wire passing slot, and the wire is pressed and clamped by the bottom sheet and the contact surface.

8. The bolt connecting structure of wire as claimed in claim 7, wherein the contact surface is in a reverse-V-shape or an arc-shape.

9. The bolt connecting structure of wire as claimed in claim 7, wherein the electronic device is a coaxial cable distributor, a single grounding device, a double grounding device, a signal amplifier, or a directional coupler module having functions of signal distributing, coupling and amplifying, and the connecting seat is a grounding seat.

10. The bolt connecting structure of wire as claimed in claim 7, wherein a wing section having at least one lock hole is transversally extended from at least one lateral side of the housing, and a gap is formed between the wing section and the connecting seat provided above the wing section.

11. The bolt connecting structure of wire as claimed in claim 10, wherein the shape of the lock hole is in a long-stripe shape.

12. A bolt connecting structure of wire, comprises:

a housing, which is an electronic device;

a connecting seat integratedly provided at a lateral side of the housing, a bolt hole is axially provided on the top surface of the connecting seat, the bottom surface of the connecting seat is provided with at least two contact surfaces, at least one wall located below the bolt hole is radially provided with an anti-disengaging screw hole;

a pressing member, which is a hollow frame member, the height of the frame slot provided at the center of the hollow frame member is larger than that of the connecting seat and the frame slot is provided on the connecting seat, the top surface of the pressing member is provided with an adjusting screw hole with respect to the bolt hole, the bottom end of the pressing member is provided with a bottom sheet, a position limiting slot and a wire passing slot are respectively provided on the two opposite walls of the pressing member with respect to the anti-disengaging screw hole, the front and the rear walls of one lateral side of the pair of the slots are provided with at least a pair of wire passing slots, an anti-disengaging screw is provided and is screwed into the anti-disengaging screw hole, and the head section of the anti-disengaging screw is received in the position limiting slot; and a bolt having a head section for being operated by tools and a thread section, the thread section is screwed and passed through the adjusting screw hole and the bottom end of the thread section is extended into the bolt hole;

by rotating the bolt, the pressing member is driven to longitudinally move, the distance between the bottom sheet and the contact surface is changed so at least two wires are easily to be inserted into the frame slot via at least one of the wire passing slots and the position limiting slot, and the wires are pressed and clamped by the bottom sheet and the contact surfaces.

13. The bolt connecting structure of wire as claimed in claim 12, wherein the contact surface is in a reverse-V-shape or an arc-shape.

14. The bolt connecting structure of wire as claimed in claim 12, wherein the electronic device is a coaxial cable distributor, a single grounding device, a double grounding device, a signal amplifier, or a directional coupler module having functions of signal distributing, coupling and amplifying, and the connecting seat is a grounding seat.

15. The bolt connecting structure of wire as claimed in claim 12, wherein a wing section having at least one lock hole is transversally extended from at least one lateral side of the housing, and a gap is formed between the wing section and the connecting seat provided above the wing section.

16. The bolt connecting structure of wire as claimed in claim 15, wherein the shape of the lock hole is in a long-stripe shape.

* * * * *